US006253050B1

(12) United States Patent
Kim

(10) Patent No.: US 6,253,050 B1
(45) Date of Patent: Jun. 26, 2001

(54) DEVELOPMENT APPARATUS OF LIQUID ELECTROPHOTOGRAPHIC PRINTER

(75) Inventor: Yong-kook Kim, Seongnam (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/471,027

(22) Filed: Dec. 23, 1999

(30) Foreign Application Priority Data

Apr. 28, 1999 (KR) ..... 99-15200

(51) Int. Cl.[7] ..... G03G 15/10
(52) U.S. Cl. ..... 399/239; 399/249
(58) Field of Search ..... 399/57, 98, 99, 399/237, 239, 240, 249

(56) References Cited

U.S. PATENT DOCUMENTS 3,741,643 * 6/1973 Smith et al. ..... 399/249
4,259,006 * 3/1981 Phillips et al. ..... 399/249
4,793,281 * 12/1988 Dobbins et al. ..... 399/249 X
5,157,443 * 10/1992 Anderson et al. ..... 399/239 X
5,481,342 * 1/1996 Arcaro et al. ..... 399/249
5,793,400 * 8/1998 Mukoyama et al. ..... 399/249 X
5,805,963 * 9/1998 Teschendorf et al. ..... 399/249

* cited by examiner

*Primary Examiner*—Sandra Brase
(74) *Attorney, Agent, or Firm*—Sughrue, Mion, Zinn, Macpeak & Seas, PLLC

(57) ABSTRACT

A development apparatus of a liquid electrophotographic printer includes a photoreceptor web having an image area where an electrostatic latent image is formed and a non-image area at both sides of the image area. A development roller is installed to correspond to the image area to which a development electrical potential of a predetermined level is applied, in which developer is supplied to the electrostatic latent image. A squeegee roller removes developer remaining on the photoreceptor web, and an air injection nozzle is installed adjacent to both ends of the development roller. The air injection nozzle injects air to move developer remaining on the photoreceptor web from the non-image area to the image area so that a boundary line between the image area and the non-image area is prevented from being developed due to a difference in electrical potential therebetween.

3 Claims, 4 Drawing Sheets

DEVELOPMENT APPARATUS OF LIQUID ELECTROPHOTOGRAPHIC PRINTER

BACKGROUND OF THE INVENTION

1. Field of the Invention

The present invention relates to a development apparatus of a liquid electrophotographic printer, and more particularly, to a development apparatus of a liquid electrophotographic printer in which the boundary portion between an image area of a photoreceptor web and a non-image area of an edge portion is prevented from being contaminated.

2. Description of the Related Art

Referring to FIG. 1, a typical liquid electrophotographic printer includes a photoreceptor web 10 circulating while being supported by a plurality of support rollers (not shown). The photoreceptor web 10 has an image area $D_1$ corresponding to a development roller 11 to which a development electrical potential $V_D$ of a predetermined level is applied during development, and a non-image area $D_2$ provided at both edge portions of the image area $D_1$.

The photoreceptor web 10 is initialized as the entire surface thereof is charged to an electrical potential $V_0$. A laser scanning unit (LSU)(not shown) scans light to the photoreceptor web 10 according to image signals so that a portion of the image area $D_1$ is charged to an image electrical potential $V_I$ to form an electrostatic latent image area $D_1'$.

The electrostatic latent image area $D_1'$ is developed as it passes the development roller 11. That is, developer adhering to the outer circumferential surface of the development roller 11 is transferred to the photoreceptor web 10 due to the difference in electrical potential between a development electrical potential $V_D$ of the development roller 11 and the image electrical potential $V_I$ of the photoreceptor web 10 so that an electrostatic latent image is developed. Developer in the electrostatic latent area is pressed by a squeegee roller 13 so that toner of the developer becomes filmy and the other liquid carrier is removed from the photoreceptor web 10.

Here, the development roller 11 constantly maintains the development electrical potential $V_D$. Thus, as the development roller 11 and the image area $D_1$ of the photoreceptor web 10 having different electrical potential levels face each other, the electrical potential $V_O$ of the image area $D_1$ is changed to a balanced electrical potential $V_E$ according to the charge balance principle as shown in the drawing. Such a state causes a difference in electrical potential at a boundary line A between the image area $D_1$ and the non-image area $D_2$, that is, both edge portions of the image area $D_1$ are developed by the developer remaining on the photoreceptor web 10. Thus, the developer at the boundary line A is pressed by the squeegee roller 13 and firmly remains on the photoreceptor web 10, to thus contaminate the photoreceptor web 10.

SUMMARY OF THE INVENTION

To solve the above problem, it is an objective of the present invention to provide a development apparatus of a liquid electrophotographic printer having an improved structure so that the boundary line between the image area and the non-image area of a photoreceptor web is prevented from being developed.

Accordingly, to achieve the above objective, there is provided a development apparatus of a liquid electrophotographic printer which includes a photoreceptor web having an image area where an electrostatic latent image is formed and a non-image area at both sides of the image area, a development roller is installed to correspond to the image area to which a development electrical potential of a predetermined level is applied and where developer is supplied to the electrostatic latent image, a squeegee roller for removing developer remaining on the photoreceptor web, and an air injection nozzle, installed adjacent to both ends of the development roller, for injecting air to move developer remaining on the photoreceptor web from the non-image area to the image area so that a boundary line between the image area and the non-image area is prevented from being developed due to a difference in electrical potential therebetween.

It is preferred in the present invention that the development apparatus of a liquid electrophotographic printer further includes an auxiliary air injection nozzle installed adjacent to both ends of the squeegee roller for injecting air to move developer remaining on the photoreceptor web from the non-image area to the image area.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE PREFERRED EMBODIMENTS

In the present invention, a device to restrict flow of developer remaining on a photoreceptor web is adopted to prevent the boundary line between an image area and a non-image area of the photoreceptor web from being developed.

Figure 2:
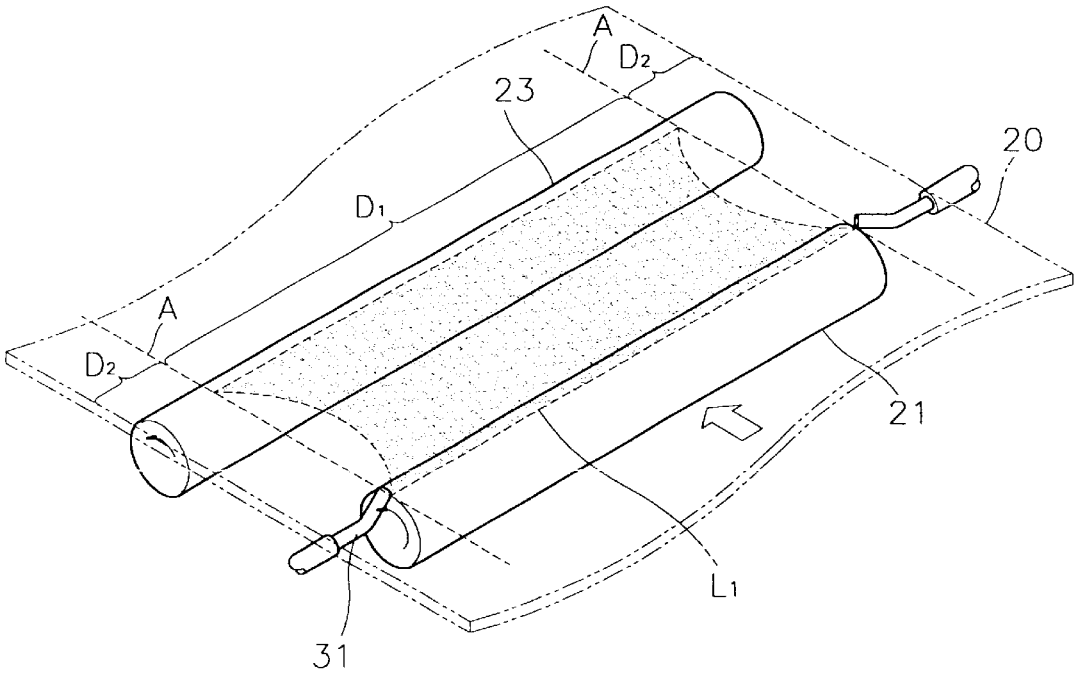
FIG. 2 is a perspective view showing a development apparatus of a liquid electrophotographic printer according to a preferred embodiment of the present invention.
Figure 3:
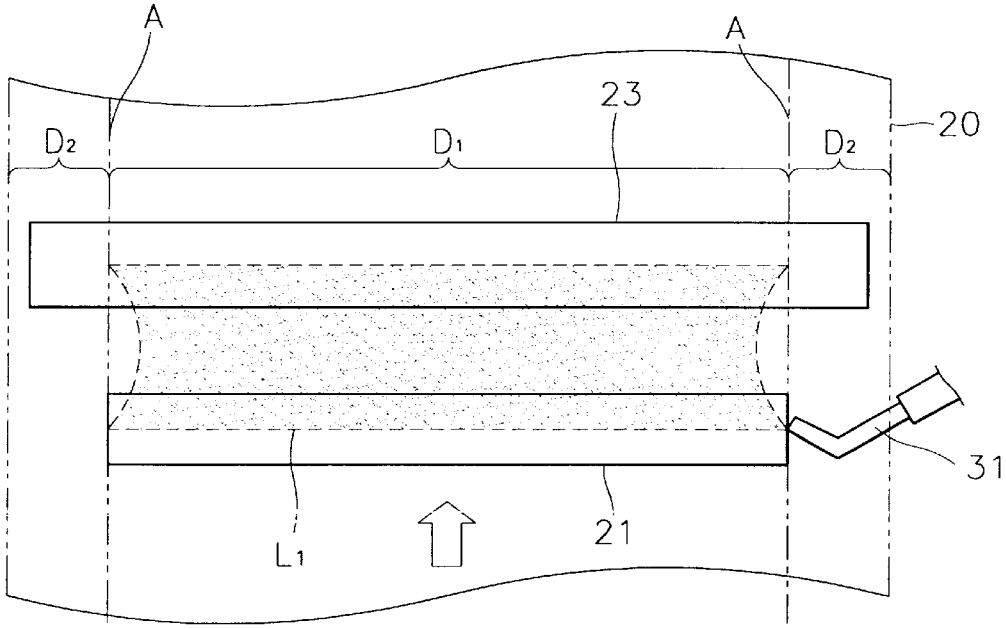
FIG. 3 is a plan view of the development apparatus of FIG. 2.

Referring to FIGS. 2 and 3, a development apparatus of a liquid electrophotographic printer according to a preferred embodiment of the present invention includes a development roller 21 for supplying developer to a photoreceptor web 20 circulating in one direction and a developer flow restricting device.

The photoreceptor web 20 has an image area $D_1$, where an electrostatic latent image is formed by a laser scanning unit (not shown), and a non-image area $D_2$ at both lateral sides of the image area $D_1$. The development roller 21 having a length corresponding to the width of the image area $D_1$ faces the image area $D_1$ and a predetermined development electrical potential is applied to the development roller 21. Developer supplied to the outer circumferential surface of the development roller 21 is transferred to the photoreceptor web 20 due to the difference in electrical potential between a development electrical potential of the development roller 21 and an image electrical potential of an electrostatic latent image.

Figure 1:
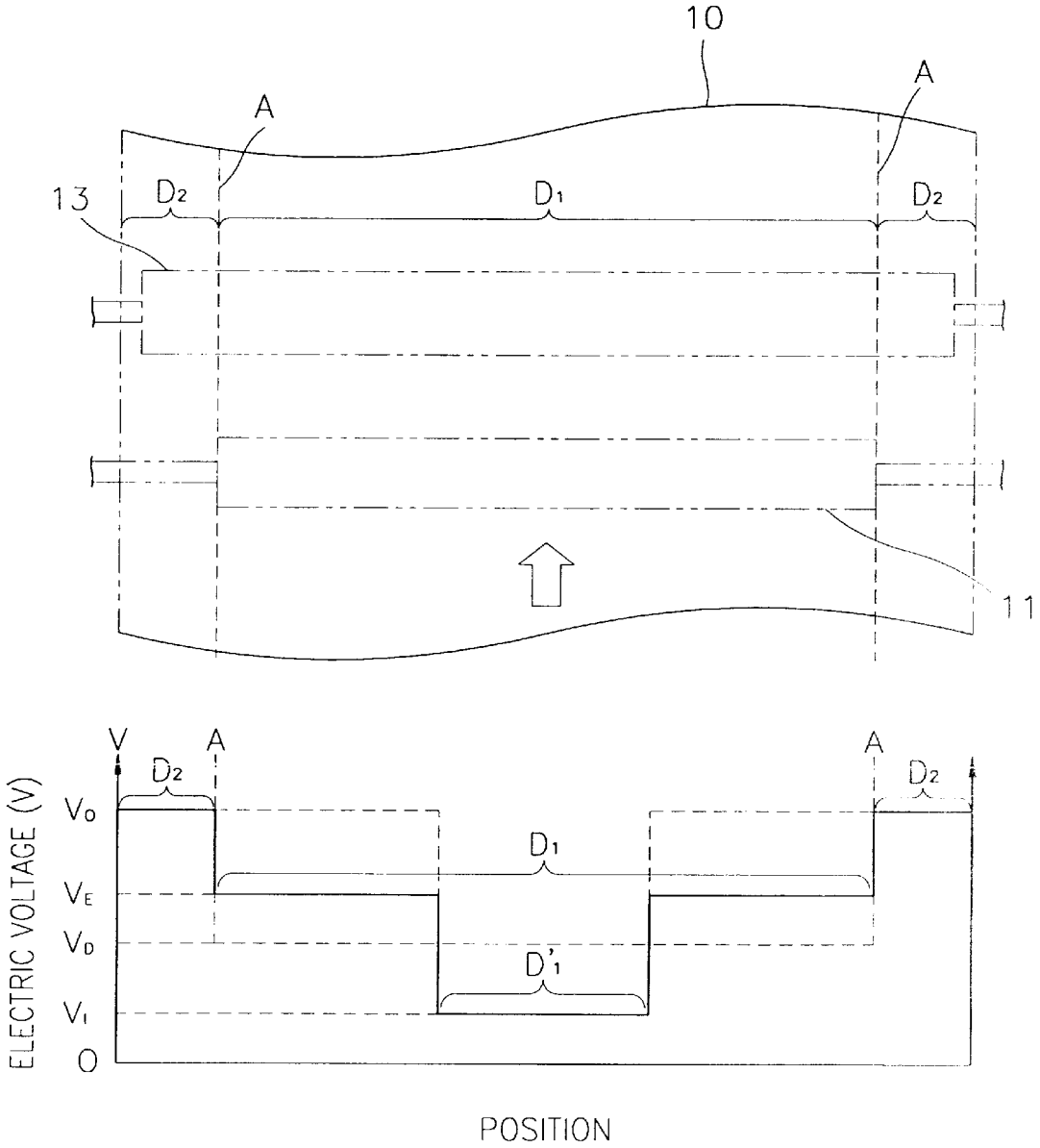
FIG .1 (PRIOR ART)
FIG. 1 is a schematic plan view for explaining a development apparatus of a general liquid electrophotographic printer in which a graph indicates electrical potentials according to the positions of the photoreceptor web.

The developer flow restricting device is for preventing developer remaining on the image area $D_1$ from moving to the non-image area $D_2$ after the electrostatic latent image of the photoreceptor web 20 passes the development roller 21. The developer flow restricting device includes a pair of air injection nozzles 31 installed adjacent to both end portions of the development roller 21. The air injection nozzle 31 is installed such that an injection portion thereof can be disposed toward the boundary line A between the image area $D_1$ and the non-image area $D_2$ and face each other. Also, the air injection nozzle 31 is located at the downstream of a line $L_1$ at which the photoreceptor web 20 and the development roller 21 face each other and where a balanced electrical potential ($V_E$ of FIG. 1) begins with respect to the proceeding direction of the photoreceptor web 20.

In the operation of the development apparatus of a liquid electrophotographic printer according to the present invention, the air injection nozzle 31 injects air toward the image area $D_1$ from the non-image area $D_2$ to prevent the developer remaining on the photoreceptor web 20 from moving toward the non-image area $D_2$ from the image area $D_1$. Therefore, the boundary area A between the image area and the non-image area can be prevented from being developed.

Figure 4:
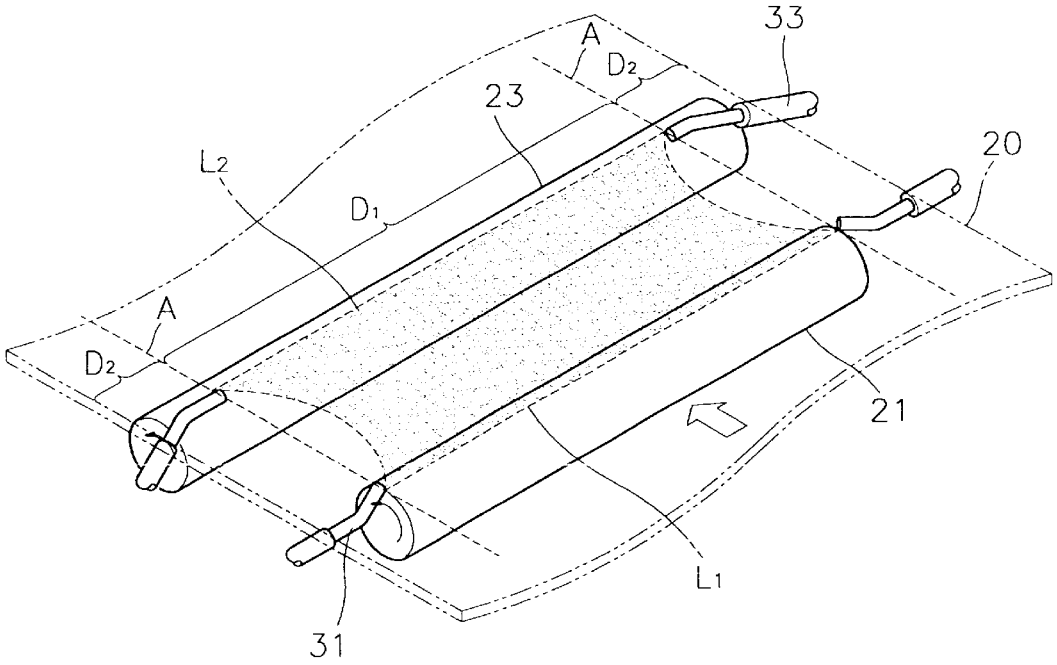
FIG. 4 is a perspective view showing a development apparatus of a liquid electrophotographic printer according to another preferred embodiment of the present invention.

FIG. 4 shows a development apparatus of a liquid electrophotographic printer according to another preferred embodiment of the present invention. Here, the same reference numerals as those in the above-described drawings indicate the same elements. It is a characteristic feature of the development apparatus of the present embodiment that a pair of auxiliary air injection nozzles 33 is further included. The auxiliary air injection nozzle 33 is installed to face a boundary line A between both ends of a squeegee roller 23 for removing developer remaining on the photoreceptor web 20. The auxiliary air injection nozzle 33 is installed at the upstream of a line $L_2$ at which the squeegee roller 23 and the photoreceptor web 20 face each other with respect to the proceeding direction of the photoreceptor web 20. The auxiliary air injection nozzle 33 injects air to remove developer which is not removed by the air injection nozzle 31 toward the image area $D_1$ from the non-image area $D_2$.

The auxiliary air injection nozzle 33 has a function of preventing a wrap-around phenomenon, that is, part of the developer passes an end portion of the squeegee roller 23 and still remains on the photoreceptor web 20. Thus, an additional wrap-around preventing injection nozzle is not needed.

As described above, according to the development apparatus of a liquid electrophotographic printer of the present invention, the developer can be prevented from being firmly fixed at the boundary line A between the image area and the non-image area of the photoreceptor web 20 and contaminating the photoreceptor web 20 by the air injected through the air injection nozzle 31.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A development apparatus of a liquid electrophotographic printer comprising:

a photoreceptor web having an image area where an electrostatic latent image is formed and a non-image area at both sides of the image area;

a development roller installed to correspond to the image area to which a development electrical potential of a predetermined level is applied and where developer is supplied to the electrostatic latent image;

a squeegee roller for removing developer remaining on the photoreceptor web; and means for preventing development of a boundary line formed by a difference in electrical potential between the image area and the non-image area.

2. The apparatus as claimed in claim 1, further comprising an auxiliary air injection nozzle installed at both sides of the squeegee roller so that the tip of each of the auxiliary nozzles can be located on a boundary line between the image area and the non-image area for injecting air to move the developer remaining on the photoreceptor web from the non-image area to the image area.

3. The apparatus as claimed in claim 1, wherein said preventing means includes an air injection nozzle installed adjacent at both ends of a development roller, for injecting air to move the developer remaining on the photoreceptor web from the non-image area to the image area.

* * * * *